US006588390B2

(12) United States Patent
Kawasaki et al.

(10) Patent No.: US 6,588,390 B2
(45) Date of Patent: Jul. 8, 2003

(54) RECOIL STARTER

(75) Inventors: Hiroji Kawasaki, Tokyo (JP); Junichi Akaike, Tokyo (JP)

(73) Assignee: Kioritz Corporation, Tokyo (JP)

( * ) Notice: Subject to any disclaimer, the term of this patent is extended or adjusted under 35 U.S.C. 154(b) by 120 days.

(21) Appl. No.: 09/863,504

(22) Filed: May 23, 2001

(65) Prior Publication Data

US 2001/0047786 A1 Dec. 6, 2001

(30) Foreign Application Priority Data

May 24, 2000 (JP) ..... 2000/153747

(51) Int. Cl.[7] ..... F02N 1/00
(52) U.S. Cl. ..... 123/185.3
(58) Field of Search ..... 123/185.3, 185.2, 123/185.4, 185.14; 185/40 R, 41 R, 41 A, 41 C

(56) References Cited

U.S. PATENT DOCUMENTS 3,164,142 A * 1/1965 Anderson ..... 123/185.14
3,306,277 A 2/1967 Gusmundsen ..... 123/185
3,814,073 A * 6/1974 Nakatani ..... 123/185.2
3,861,374 A * 1/1975 Dooley et al. ..... 123/185.14
4,492,190 A * 1/1985 Greenwood et al. ..... 123/185.2
4,922,868 A * 5/1990 Ohkanda ..... 123/179.24
5,118,978 A * 6/1992 Matsumoto et al. ..... 310/153
5,537,966 A * 7/1996 Ohnishi ..... 123/185.14

OTHER PUBLICATIONS

Copy of Japanese Examined Utility Model Publication No. 6–16964 (1994) and partial translation thereof.

* cited by examiner

*Primary Examiner*—Mahmoud Gimie
(74) *Attorney, Agent, or Firm*—Baker Botts LLP

(57) ABSTRACT

A recoil starter includes a rotary driving member that is adapted to be rotated by pulling a recoil rope and an interlocking rotary member that is adapted to be rotated independently of the rotary driving member. A buffering spring is coupled between the rotary driving member and the interlocking rotary member. The buffering spring, which may be a torsion coil spring or a spiral spring, applies a rotational bias between the rotary driving member and the interlocking rotary member and is adapted to transmit the rotation of the rotary driving member to the interlocking rotary member.

10 Claims, 3 Drawing Sheets

RECOIL STARTER

BACKGROUND OF THE INVENTION

The present invention relates to a recoil starter for an internal combustion engine and, in particular, to a recoil starter that allows fluctuations in the pulling force of a recoil rope to be reduced.

The recoil starters conventionally used for small internal combustion engines usually have a rope reel that is rotated by pulling a recoil rope that is wound onto the rope reel and fitted with a handle. The resulting rotation of the rope reel is transmitted by, for example, a centrifugal ratchet mechanism, to the crankshaft of the internal combustion engine, thereby "start-up" the internal combustion engine.

In the case of an internal combustion engine which is provided with such a recoil starter, a decompressor is frequently attached to the internal combustion engine in order to minimize the pulling force (rope pulling force) of the recoil rope that is required for starting the internal combustion engine.

It is required, in the case of the conventional recoil starter described above, to strongly and quickly pull the recoil rope in order to start up the internal combustion engine. Furthermore, although it is possible to rotate the crankshaft by pulling the recoil rope, it has been impossible to obtain a smooth rope-pulling operation due to large fluctuations of the load imposed on the recoil rope by the engine, i.e., the fluctuations originating from the compression stroke or sliding resistance of the piston relative to the rotation of the crankshaft, thereby making it difficult for a person having a weak physical strength to start the internal combustion engine.

When a decompressor is attached to the internal combustion engine, it is possible to reduce the rope pulling force required for actuating the internal combustion engine. However, the provision of a decompressor leads not only to an increased complication of the structure of the device, and hence to an increase in manufacturing cost, but also to the release of unburned air-fuel mixture into the atmosphere and contamination of the environment.

BRIEF SUMMARY OF THE INVENTION

The present invention has been made to overcome the aforementioned problems. It is, in particular, an object of the present invention to provide a recoil starter that permits fluctuations of the rope pulling force to be reduced, thereby making it possible to perform a smooth rope-pulling operation and also to easily actuate the internal combustion engine, even by a person having a weak physical strength.

With a view to attaining the aforementioned object, there is provided, in accordance with the present invention, a recoil starter having a rotary driving member that is adapted to be rotated by pulling a recoil rope and an interlocking rotary member that is adapted to be rotated independently of the rotary driving member. A buffering spring is coupled between the rotary driving member and the interlocking rotary member. The buffering spring, which may be a torsion coil spring or a spiral spring, applies a rotational bias between the rotary driving member and the interlocking rotary member and is adapted to transmit the rotation of the rotary driving member to the interlocking rotary member.

In a preferred embodiment of the recoil starter according to the present invention, the rotary driving member and the interlocking rotary member are disposed on a common rotational axis.

The rotary driving member is, preferably, a rope reel which is adapted to have the recoil rope wound thereon. The rope reel may have an annular cavity, in which case the buffering member is disposed inside the annular cavity of the rope reel.

In preferred embodiments, the interlocking rotary member is a power transmission pulley to which the rotation of the rotary driving member is transmitted through the buffering member. The recoil starter further includes a centrifugal ratchet mechanism coupled to the power transmission pulley and adapted to be coupled to a crankshaft of an internal combustion engine for transmitting the rotation of the power transmission pulley to the crankshaft of the internal combustion engine.

In preferred embodiments of the recoil starter of the present invention as constructed above, when the recoil rope (recoil handle) is pulled, the rope reel of the rotary driving member is caused to rotate, and the rotation of the rotary driving member is transmitted via the buffering member to the power transmission pulley of the interlocking rotary member. The rotation of the power transmission pulley is then transmitted via the centrifugal ratchet mechanism to the crankshaft of the internal combustion engine, thereby starting the internal combustion engine through the rotation of the crankshaft.

Since the buffering member is elastically compressed in the rotational direction of the rope reel when the recoil rope is pulled, the buffering member functions not only as a power transmitting member for transmitting the rotation of the rope reel to the power transmission pulley but also as a power reservoir and a cushion or a shock absorber, thereby making it possible to minimize the fluctuations of the rope pulling force as much as possible.

Therefore, it is now possible with the recoil starter of the present invention to attain a smoother rope-pulling operation as compared with the conventional recoil starter, thereby making it possible to easily actuate the internal combustion engine, even for a person having a weak physical strength.

Furthermore, since the recoil starter according to the present invention can be constructed by simply disposing a buffering member such as a torsion coil spring in a cavity of the rope reel of a conventional recoil starter, the increases in total weight and in the manufacturing cost can be minimized. It may also not be necessary to provide a decompressor.

DETAILED DESCRIPTION OF THE INVENTION

Figure 1:
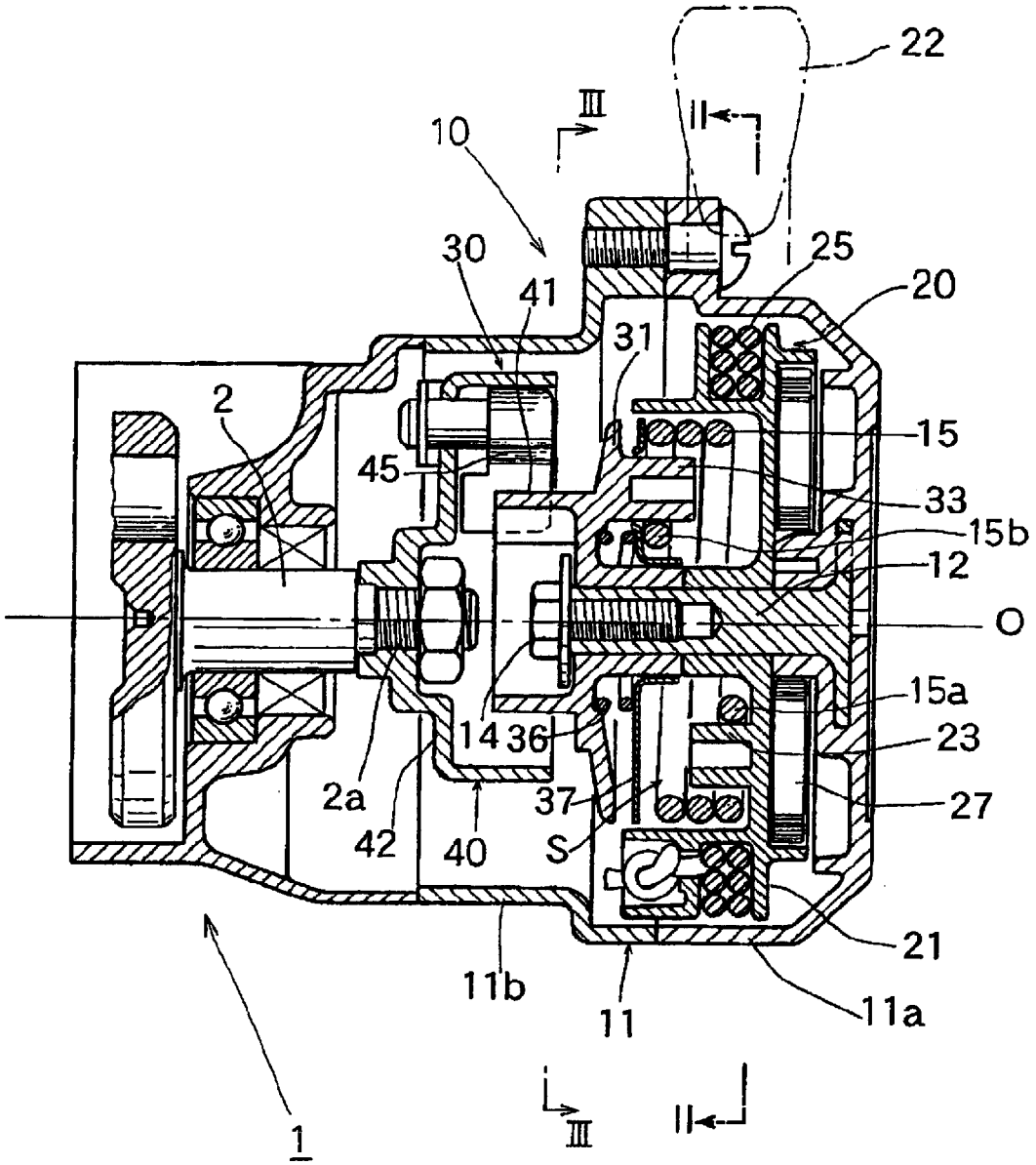
FIG. 1 is a cross-sectional view illustrating one embodiment of the recoil starter according to the present invention.

The recoil starter 10 shown in FIG. 1 is adapted to be disposed close to one end portion 2*a* of the crankshaft 2 of an internal combustion engine 1, such as a small air-cooled two-stroke gasoline engine, and comprises a case 11 of two-piece structure, which is cylindrical as a whole in configuration so as to enable it to be attached to one side of the internal combustion engine 1. A rotary driving member 20, which is adapted to be rotated by pulling a recoil rope 25 by means of a handle 22, is disposed inside the outer case 11*a* of the case 11 which is located remote from the internal combustion engine 1. An interlocking rotary member 30, which is adapted to be rotated independently of the rotary driving member 20, is disposed inside an inner case 11*b*.

More specifically, a supporting axle 12 projects distally toward the inner case 11*b* from the central portion of the outer case 11*a*. A rope reel 21 having the recoil rope 25 wound around it is rotatably fitted on a proximal portion of the supporting axle 12. A power transmitting pulley 31 is rotatably fitted on a distal portion of the supporting axle 12 for rotation independently of the rotation of the rope reel 21. A fastening screw 14 is threaded into the distal end of the supporting axle 12.

The axis of the supporting axle 12 as well as the rotational axes of the rope reel 21 and the power transmitting pulley 31 are coaxially aligned with the rotational axis O of the crankshaft 2 of the internal combustion engine 1. A torsion coil spring 15 functioning as a buffering member is disposed coaxially with the rotational axis O in a cavity S of the rope reel 21.

Figure 2:
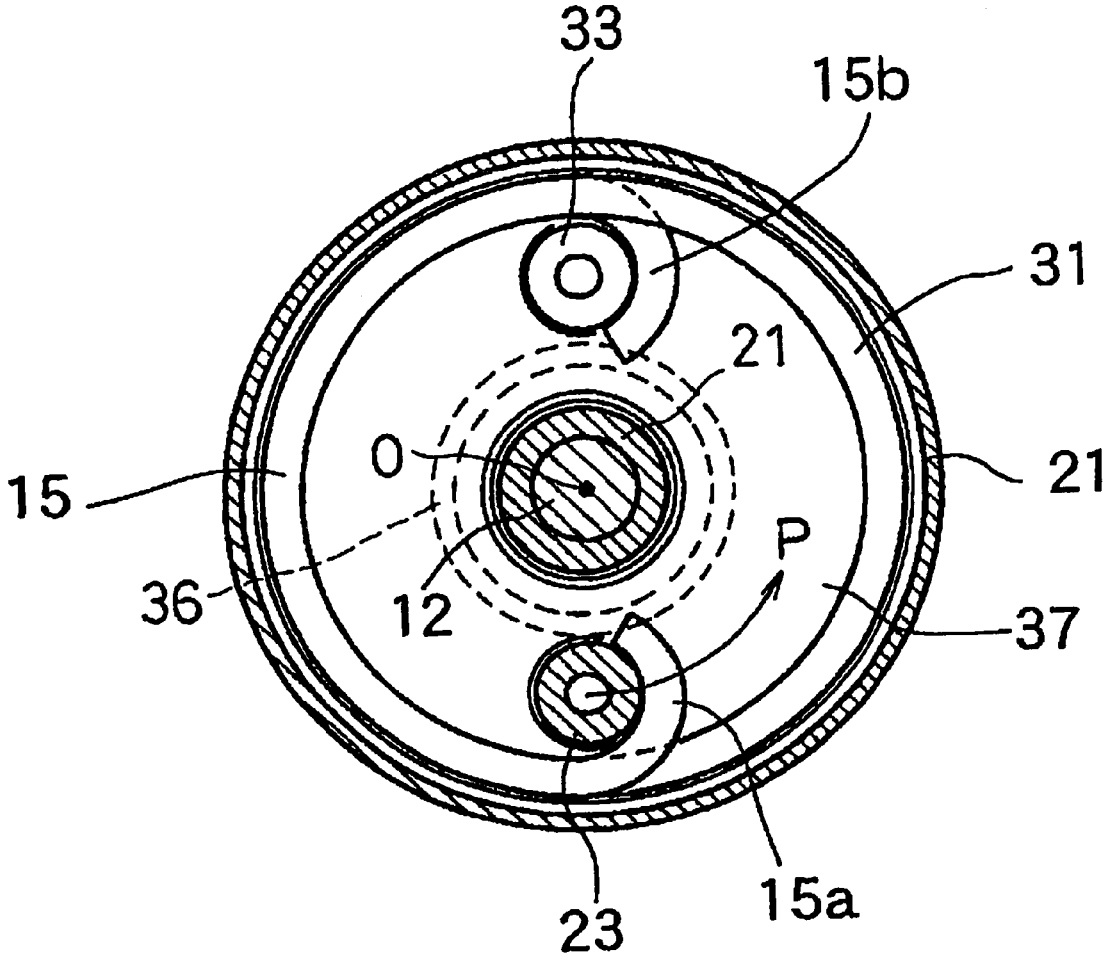
FIG. 2 is a cross-sectional view taken along the line II—II in FIG. 1.

As shown in FIG. 2, the torsion coil spring 15 is constructed such that a hook portion 15*a* at one end of the torsion coil spring 15 and which is located close to the outer case 11*a* is hooked to a first locking portion 23 that projects from the rope reel 21. A hook portion 15*b* at the other end of the torsion coil spring 15 and which is located close to the inner case 11*b* is hooked to a second locking portion 33 that projects from the power transmitting pulley 31. A compression coil spring 36 that is engaged in slight compression between the power transmitting pulley 31 and a spring disk shoe 37 biases the torsion coil spring 15 toward the rope reel 21 along the rotational axis O.

A recoil spiral spring 27 is arranged between the outer case 11*a* and the rope reel 21 in such a manner that the outer end thereof is secured to the rope reel 21 and the inner end thereof is secured to a central portion of the outer case 11*a* in the same manner as that of the conventional recoil starter. Whenever the rope reel 21 is released after having been rotated to a desired extent by pulling out of the recoil rope 25, the recoil rope 25 is automatically rewound onto the rope reel 21 by the restoring force of the recoil spiral spring 27.

Figure 3:
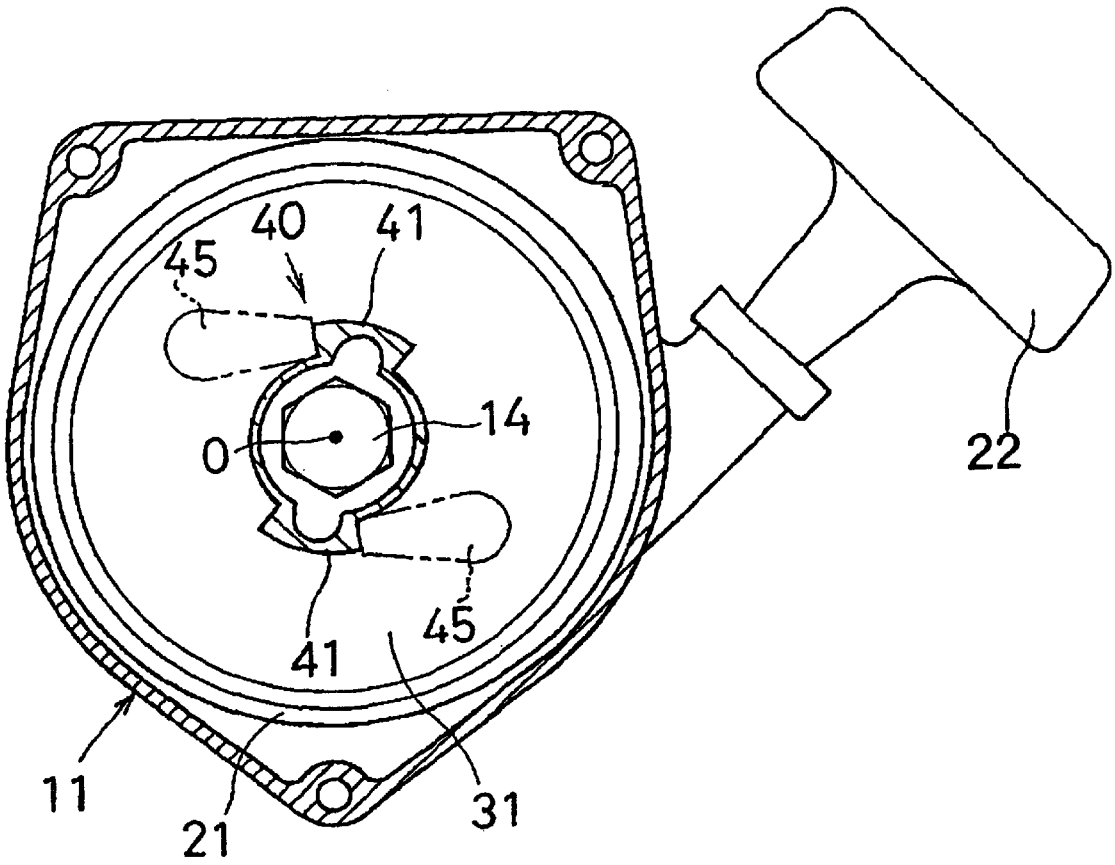
FIG. 3 is a cross-sectional view taken along the line III—III in FIG. 1.

The interlocking rotary member 30 consists of the power transmitting pulley 31 and a centrifugal ratchet mechanism 40. As shown in FIG. 3, the centrifugal ratchet mechanism 40 comprises a pair of power transmitting protrusions 41, each projecting from the surface of the power transmitting pulley 31 which faces the internal combustion engine 1, and a clutch claw case 42, which is fixed to the end portion 2*a* of the crankshaft 2. The clutch claw case 42 is provided with a pair (for example) of starting claws 45, each pivotally supported by the clutch claw case 42. The starting claws 45 are normally urged inwardly (toward the rotational axis O) by means of a spring (not shown) so as to engage with the aforementioned pair of power transmitting protrusions 41. However, when the internal combustion engine 1 is started, the starting claws 45 are caused to rotate or pivot outward in the radial direction due to the centrifugal force produced by the rotation of the clutch claw case 42 as it is driven by the crankshaft 2, thereby permitting the starting claws 45 to disengage from the power transmitting protrusions 41.

In the operation of the recoil starter 10 of the embodiment, when the recoil rope 25 is pulled, the rope reel 21 of the rotary driving member 20 is caused to rotate in the direction P in FIG. 2. The rotation of the rotary driving member 20 is transmitted via the torsion coil spring 15 to the power transmission pulley 31 of the interlocking rotary member 30. The rotation of the power transmission pulley 31 is then transmitted via the centrifugal ratchet mechanism 40 (the power transmitting protrusions 41 and the starting claws 45) to the crankshaft 2 of the internal combustion engine 1, thereby starting up the internal combustion engine 1 through the rotation of the crankshaft 2.

Since the torsion coil spring 15 is elastically compressed in the rotational direction of the rope reel 21 (in the direction P in FIG. 2) when the rope reel 21 is rotated by pulling out the recoil rope 25, the torsion coil spring 15 functions not only as a power transmitting member for transmitting the rotation of the rope reel 21 to the power transmission pulley 31, but also as a power reservoir and a cushion or a shock absorber, thereby making it possible to minimize, as much as possible, the fluctuations in pulling force of the recoil rope 25.

Accordingly, the recoil starter 10 of the embodiment provides a smoother rope-pulling operation as compared with the conventional recoil starter, thereby making it possible for even a weak person to easily start the internal combustion engine.

Furthermore, since the recoil starter according to the present invention can be constructed by simply disposing a buffering member, such as a torsion coil spring or a spiral spring, in a cavity of the rope reel of a conventional recoil starter, the increases in total weight and in the manufacturing cost can be minimized, Also, it may not be necessary to provide the internal combustion engine with a decompressor.

The embodiment of the present invention described above and shown in the drawings is intended to be exemplary. Numerous variations and modifications of the exemplary embodiment can be made by those skilled in the art without departing from the spirit and scope of the invention as set forth in the accompanying claims.

What is claimed is:

1. A recoil starter, comprising a rotary driving member that is adapted to be rotated by pulling a recoil rope, an interlocking rotary member that is adapted to be rotated independently of the rotary driving member, a buffering spring coupled directly between the rotary driving member and the interlocking rotary member, applying a rotational bias between the rotary driving member and the interlocking rotary member, an adapted to transmit the rotation of the rotary driving member to the interlocking rotary member, and a hook portion at one end of the buffering spring and located within the buffering spring.

2. The recoil starter according to claim 1, wherein the rotary driving member and the interlocking rotary member are disposed on a common rotational axis.

3. The recoil starter according to claim 1, wherein the buffering member is a torsion coil spring or a spiral spring.

4. The recoil starter according to claim 2, wherein the buffering member is a torsion coil spring or a spiral spring.

5. The recoil starter according to any one of claims 1 to 4, wherein the rotary driving member is a rope reel which is adapted to have the recoil rope wound thereon, the rope reel has an annular cavity, and the buffering member is received in the annular cavity of the rope reel.

6. The recoil starter according to any one of claims 1 to 4, wherein the interlocking rotary member includes a power transmission pulley to which the rotation of the rotary driving member is transmitted through the buffering member and a centrifugal ratchet mechanism coupled to the power transmission pulley and adapted to be coupled to a crankshaft of an internal combustion engine for transmitting the rotation of the power transmission pulley to the crankshaft of the internal combustion engine.

7. A recoil starter, comprising a rotary driving member that is adapted to be rotated by pulling a recoil rope, an interlocking rotary member that is adapted to be rotated independently of the rotary driving member, and a buffering spring coupled between the rotary driving member and the interlocking rotary member, applying a rotational bias between the rotary driving member and the interlocking rotary member, and adapted to transmit the rotation of the rotary driving member to the interlocking rotary member, wherein the interlocking rotary member includes a power transmission pulley to which the rotation of the rotary driving member is transmitted through the buffering member and a centrifugal ratchet mechanism coupled to the power transmission pulley and adapted to be coupled to a crankshaft of an internal combustion engine for transmitting the rotation of the power transmission pulley to the crankshaft of the internal combustion engine.

8. The recoil starter according to claim 7, wherein the rotary driving member and the interlocking rotary member are disposed on a common rotational axis.

9. The recoil starter according to claim 7, wherein the buffering member is a torsion coil spring or a spiral spring.

10. The recoil starter according to claim 8, wherein the buffering member is a torsion coil spring or a spiral spring.

* * * * *

US006588390C1

(12) INTER PARTES REEXAMINATION CERTIFICATE (0060th)

United States Patent

Kawasaki et al.

(10) Number: US 6,588,390 C1

(45) Certificate Issued: Apr. 21, 2009

(54) RECOIL STARTER

(75) Inventors: Hiroji Kawasaki, Tokyo (JP); Junichi Akaike, Tokyo (JP)

(73) Assignee: Kioritz Corporation, Ohme-Shi, Tokyo (JP)

Reexamination Request:
No. 95/000,039, Apr. 16, 2004

Reexamination Certificate for:

| | |
|---|---|
| Patent No.: | **6,588,390** |
| Issued: | **Jul. 8, 2003** |
| Appl. No.: | **09/863,504** |
| Filed: | **May 23, 2001** |

(30) Foreign Application Priority Data

May 24, 2000 (JP) ..... 2000/153747

(51) Int. Cl.
*F02N 1/00* (2006.01)

(52) U.S. Cl. ..... 123/185.3

(58) Field of Classification Search ..... None
See application file for complete search history.

(56) References Cited

U.S. PATENT DOCUMENTS 3,306,277 A 2/1967 Gudmundsen 5,287,832 A 2/1994 Uhl

FOREIGN PATENT DOCUMENTS

| | | |
|---|---|---|
| JP | 6-16964 | 4/1989 |
| JP | 2-149872 | 12/1990 |

OTHER PUBLICATIONS

Calculation and Design of Metal Springs, Chapman & Hall Ltd, London, 1966, pp. 112–127.

Spring Design and Application, McGraw–Hill Book Company, New York, 1961, pp. 36, 37, 48, 126, 127, 247, 248 and 250.

*Primary Examiner*—Aaron J. Lewis

(57) ABSTRACT

A recoil starter includes a rotary driving member that is adapted to be rotated by pulling a recoil rope and an interlocking rotary member that is adapted to be rotated independently of the rotary driving member. A buffering spring is coupled between the rotary driving member and the interlocking rotary member. The buffering spring, which may be a torsion coil spring or a spiral spring, applies a rotational bias between the rotary driving member and the interlocking rotary member and is adapted to transmit the rotation of the rotary driving member to the interlocking rotary member.

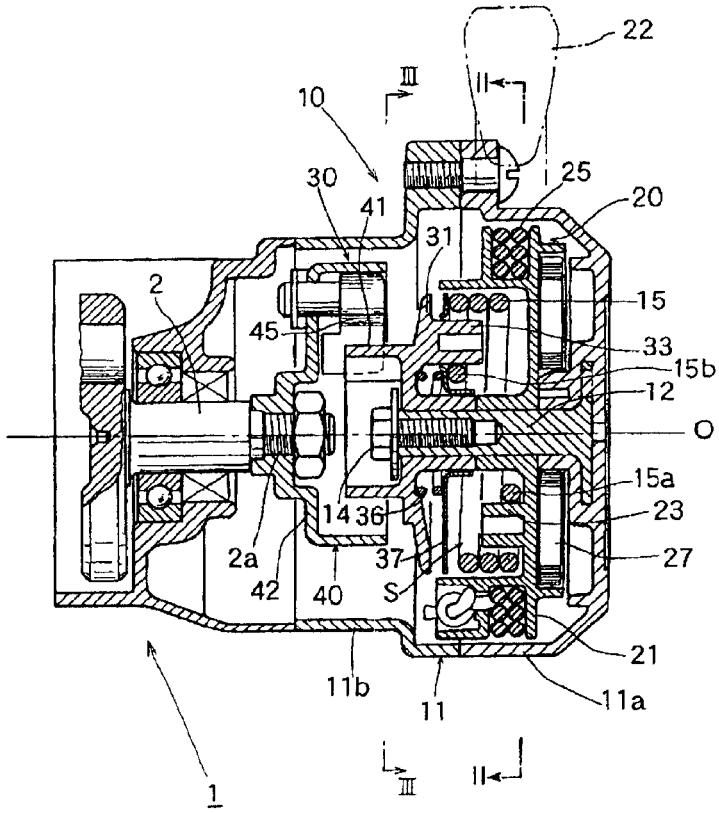

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 4, 9 and 10 are cancelled.

Claims 1 and 5–7 are determined to be patentable as amended.

Claims 2 and 8, dependent on an amended claim, are determined to be patentable.

1. A recoil starter, comprising a rotary driving member that is adapted to be rotated by pulling a recoil rope, an interlocking rotary member that is adapted to be rotated independently of the rotary driving member, a [buffering] *torsion coil* spring coupled directly between the rotary driving member and the interlocking rotary member, applying a rotational bias between the rotary driving member and the interlocking rotary member, [an] *and* adapted to transmit the rotation of the rotary driving member to the interlocking rotary member, [and]

*a compression coil spring adapted to bias the torsion coil spring toward the rotary driving member via a spring shoe in the direction of a rotary axis of the rotary driving member, and* a *first* hook portion at one end of the [buffering] *torsion coil* spring [and] *abut against and locked on a first locking portion protrudingly mounted on the rotary driving member and a second hook portion at the other end of the torsion coil spring abut against and locked on a second locking portion protrudingly mounted on the interlocking rotary member, both hook portions being* located within *the outer diameter of an adjacent winding of* the [buffering] *torsion coil* spring.

5. The recoil starter according to any one of claims 1 to [4] *2*, wherein the rotary driving member is a rope reel which is adapted to have the recoil rope wound thereon, the rope reel has an annular cavity, and the [buffering member] *torsion coil spring* is received in the annular cavity of the rope reel.

6. The recoil starter according to any one of claims 1 to [4] *2*, wherein the interlocking rotary member includes a power transmission pulley to which the rotation of the rotary driving member is transmitted through the [buffering member] *torsion coil spring* and a certrifugal ratchet mechanism coupled to the power transmission pulley and adapted to be coupled to a crankshaft of an internal combustion engine for transmitting the rotation of the power transmission pulley to the crankshaft of the internal combustion engine.

7. A recoil starter, comprising a rotary driving member that is adapted to be rotated by pulling a recoil rope, an interlocking rotary member that is adapted to be rotated independently of the rotary driving member, [and]

a [buffering] *torsion coil* spring coupled between the rotary driving member and the interlocking rotary member, applying a rotational bias between the rotary driving member and the interlocking rotary member, and adapted to transmit the rotation of the rotary driving member to the interlocking rotary member, *and*

*a compression coil spring adapted to bias the torsion coil spring toward the rotary driving member via a spring shoe in the direction of a rotary axis of the rotary driving member,* wherein the interlocking rotary member includes a power transmission pulley to which the rotation of the rotary driving member is transmitted through the [buffering member] *torsion coil spring* and a certrifugal ratchet mechanism coupled to the power transmission pulley and adapted to be coupled to a crankshaft of an internal combustion engine for transmitting the rotation of the power transmission pulley to the crankshaft of the internal combustion engine.

* * * * *